United States Patent [19]

Hoshino et al.

[11] 4,255,043

[45] Mar. 10, 1981

[54] ELECTROSTATIC RECORDING METHOD AND APPARATUS BY DOUBLY CONTROLLING ION FLOW

[75] Inventors: Yasushi Hoshino, Yokosuka; Tooru Toida, Yokohama; Yukio Tokunaga; Kazuyoshi Tateishi, both of Yokosuka; Rikuo Takano, Zushi, all of Japan

[73] Assignee: Nippon Telegraph and Telephone Public Corporation, Tokyo, Japan

[21] Appl. No.: 56,817

[22] Filed: Jul. 12, 1979

[51] Int. Cl.[3] ..... G03G 15/052; G03G 13/052

[52] U.S. Cl. ..... 355/3 SC; 346/159; 430/53

[58] Field of Search ..... 355/3 SC; 430/53; 358/300; 346/155, 158, 159

[56] References Cited

U.S. PATENT DOCUMENTS

| | | | |
|---|---|---|---|
| 3,673,596 | 6/1972 | McMahon | 346/158 |
| 4,006,983 | 2/1977 | Pressman et al. | 355/3 SC |
| 4,137,537 | 1/1979 | Takahashi | 346/159 |

*Primary Examiner*—William H. Beha, Jr.

*Attorney, Agent, or Firm*—Blakely, Sokoloff, Taylor & Zafman

[57] ABSTRACT

After uniformly charging one insulator side of an insulator mesh the other side of which is subjected to electroconductive treatment, the ion flow controlled by recording signals is irradiated for a short period of time on the insulator mesh to obtain a charge distribution wherein the charge on the insulator side is neutralized corresponding to the dots to be recorded. Via mesh apertures which have been freed from the charge by neutralization, the ion flow is irradiated for a time far longer than the above-said short time on an insulating recording substrate, to obtain thereon an electrostatic latent image having an amplified charge distribution.

12 Claims, 13 Drawing Figures

ELECTROSTATIC RECORDING METHOD AND APPARATUS BY DOUBLY CONTROLLING ION FLOW

BACKGROUND OF THE INVENTION

The present invention generally concerns electrostatic recording systems, and more particularly it concerns a method and an apparatus for electrostatic recording by doubly controlling ion flows wherein the controlling voltage for recording is low (below 50 V), the electrostatic latent image recording unit can be placed at a distance (not less than 0.1 mm) away from the part where recording is to be made, and the high speed recording can be conducted.

In the prior art, there have been proposed various electrostatic recording methods: one example is disclosed in the Proceedings of the Fifth Conference of the Institute of Image Electronics Engineers of Japan, 1977, "Ion Flow controlled Electrostatic Facsimile Recording" by Kubota and Miyoshi, and it discusses a method of obtaining a desired pattern of electrostatic latent image by using control electrodes having apertures and controlling the ion flow which passes these apertures. More particularly, a corona charger, and a back electrode are opposed with a predetermined distance therebetween, control electrodes are provided between the two, and an electrostatic recording paper is fed in front of the back electrode. The control electrode is so constructed that paired conductive layers are opposed across the thickness of an insulator and an aperture is bored which passes through the conductive layers and the insulator. When the controlling voltage is applied across the paired conductive layers of such a control electrode in such a way that the electric field within the aperture is reverse to an electric field directed from the corona charger to the back electrode, the ion flow passing the aperture and bombarding the recording paper may be cut off by the electric field within the aperture. Thus, a pattern of electrostatic latent image may be formed on the electrostatic recording paper corresponding to the application of the control voltage. In this method, although the controlling voltage for recording is advantageously as low as several of tens of volts and the control electrode is spaced apart from the recording paper, leaving behind spacing of more than 1 mm, there arise problems that the recording speed is very low, 0.67 mm/sec. at the most, because of the low intensity of corona current, and that a special electrostatic recording paper having insulating layers on the surface must be used intead of plain papers.

Another example of using an electrode pin array for electrostatic latent image formation is disclosed in the Proceedings of 1977 IEEE-IAS Conference "High Speed Nonimpact Printer Using Dielectric Drum" by Horie and Takahashi. According to this example, a corona charger and a latent image forming electrode pin are arranged along the outer periphery of the insulator drum which is rotatably supported. After uniformly charging the insulator drum surface with the corona charger, the charge on the insulator drum is neutralized responsive to the recording signal supplied to the latent image forming pin electrode to obtain a pattern of electrostatic latent image.

Although a high speed recording is possible according to this method, there are such defects as a need to apply a high voltage pulse (several of hundreds of volts) to the latent image forming electrode pin, a need to control the space between the electrode pin and the insulator drum to 20–+um, and that the electrode pin will discharge owing to the high working voltage when contaminated, thereby making the record unstable.

Further in the art, there is known a method of controlling the ion flow without using the above-mentioned control electrode or the latent image forming electrode pin, but using a photoconductor mesh (a metal mesh which is deposited with a photoconductive layer in such a way as not to fill the mesh apertures). More particularly, the photoconductive layer on the photoconductor mesh is charged by the corona discharge from a corona charger provided on the side of the photoconductive layer, and the photoconductor mesh is then exposed to light from a light source provided on the side of the photoconductive layer according to a desired pattern to neutralize the photo-conductive layer thus exposed, thereby forming the pattern of electrostatic latent image. Finally, by discharging corona from a corona charger provided on the side of the metal mesh, a recording paper facing the photoconductive layer is charged. In the last step of the above-mentioned process, the area including the photoconductive layer neutralized by being exposed to the light permits corona ion to pass through the mesh apertures to charge the recording paper responsive thereto whereas within the area including the photoconductive layer which has not been exposed to the light and where the charges of the same polarity as that of the discharged corona remain, the corona ion cannot pass the mesh apertures and the portion corresponding thereto on the recording paper does not become charged, thereby forming the pattern of electrostatic latent image on the recording paper. Such a conventional example is disclosed in the Proceedings of the Society of Electrophotography of Japan, 1975, "Latent Image Formation Using Photoconductor Mesh", Ozeki et al. Subject matters of U.S. Pat. Nos. 3,625,604, No. 3,694,200, No. 4,006,983, and No. 4,064,439 are also based on the same principle as the above.

In this method, the photoconductive layer does not contact the recording paper and the recording speed is as high as 10 cm/sec. When applying to the printer, however, the optical scanning system is used for recording which requires a laser source, a modulator, and a lens system, complicating the construction and causing difficulties in adjustment. The use of photoconductive layer shortens the life of the photoconductor mesh.

SUMMARY OF THE INVENTION

Accordingly, the present invention was contrived in order to remove these defects of the prior art, and its main object is to provide a method and an apparatus for electrostatic recording by doubly controlling ion flow which can achieve the high speed printing purely electrically in the non-contact manner and at low controlling voltage.

According to one aspect of the present invention, there is provided a method for electrostatic recording by doubly controlling ion flow comprising the steps of uniformly charging one surface of an insulator mesh, the other, opposite surface of which is subjected to electroconductive treatment; providing a charge distribution on the one surface of the insulator mesh corresponding to the dots to be recorded by feeding to the insulator mesh ion flow controlled by a recording signal; applying ion flow from the side of the electroconductive surface of the insulator mesh and controlling the ion flow by the charge distribution on the insulator mesh to form, on an insulating recording substrate, an electrostatic latent image of the charge distribution whose charge is amplified as compared with that on the insulator mesh; and finalizing a record using the thus formed electrostatic latent image.

According to another aspect of the invention, there is provided an apparatus for electrostatic recording by doubly controlling ion flow comprising an insulator mesh movably supported and having one insulating surface and the other, opposite surface which is subjected to electroconductive treatment; a first corona charger spaced apart from the one insulating surface of the insulator mesh, for uniformly charging the insulator with electric charge of one polarity; a second corona charger spaced apart from the insulator a predetermined distance and having a control electrode with apertures, for providing on the one insulating surface a charge distribution corresponding to a recording control signal when the recording control signal is applied to the control electrode and ion current of the other polarity is applied to the insulator mesh through the apertures; a third corona charger provided on the side of the other, electroconductive surface of the insulator mesh and spaced apart from the insulator mesh a predetermined distance, for forming an electrostatic latent image of the charge distribution, whose charge is amplified as compared with that on the insulator mesh, on an insulating recording substrate which is movable relative to the insulator mesh, by applying ion current of the one polarity to the substrate through the charge distribution on the insulator mesh; and means for finalizing a record using the thus formed electrostatic latent image.

Brief Description of the Drawings

The other objects, advantages, and features of the present invention will become further clear from the detailed description given below in respect of the drawings attached hereto wherein.

DESCRIPTION OF THE PREFERRED EMBODIMENTS

Figure 1:
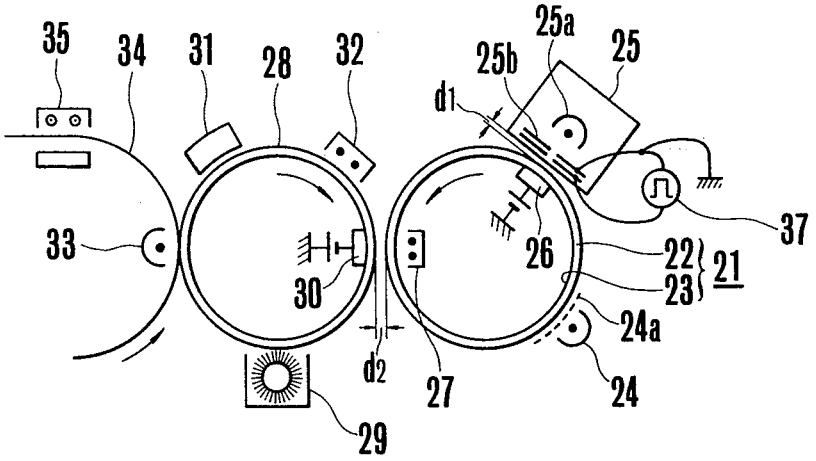
FIG. 1 is a schematic view to explain the construction of one embodiment of the electrostatic recording method according to the present invention.

Referring to FIG. 1, reference numeral 21 generally denotes an insulator mesh which comprises an insulator 22 having one insulating surface and a conductive surface 23 which is formed on the other, opposite surface of the insulator 22. The insulator mesh 21 is formed like a cylinder and through holes are formed in the conductive surface, the through holes and the mesh apertures being in communication. The insulator mesh 21 is supported rotatably by a suitable drive means (not shown in the drawing) and is rotated at a predetermined speed in the counterclockwise direction as shown by arrow. There is provided a corona charger 24 spaced apart a predetermined distance from the outer peripheral surface of the insulator 22 of the insulator mesh 21. The corona charger 24 provided with a mesh **24*a* generates an ion flow to uniformly charge electric charge of one polarity, such as positive charge on the outer peripheral surface of the insulator 22. On the insulator side of the insulator mesh 21 and downstream the corona charger 24 is provided a ion flow pulse generator 25 for recording spaced away from the outer periphery of the insulator 22 by a predetermined distance. The controlling electrode with apertures for this corona charger 25, that is, a recording electrode 25*b* is fed with the recording pulse from a pulse source 37 to control the ion flow from a corona source 25*a* passing apertures. As will be explained later, the ion flow from the corona charger 25 is of different polarity from that of the ion flow of the corona charger 24 and, for instance, it is a negative charge current. Opposite the corona charger 25 and on the side of the conductive surface of the insulator mesh 21 is provided a back electrode 26 to form an electric field between the control electrode and the insulator mesh in order to prevent spreading of the ion flow and to increase the density of the ion flow passing the control electrode. Further downstream the corona charger 25 and on the side of the conductive surface of the insulator mesh 21 is provided a corona charger 27. This corona charger is different from those corona chargers 24 and 25 mentioned before, and has neither a mesh in its front nor apertures for control electrode, thereby enabling to obtain an ion flow which extends the whole width of the corona charger 27. In this case, the ion flow is of the same polarity as that of the corona charger 24**.

A cylindrical insulator drum 28, which is an insulating recording substrate, is rotatably juxtaposed to the cylindrical insulator mesh 21 with a predetermined distance therebetween. The insulator drum 28 is rotated in the clockwise direction, for instance at the same speed as that of the insulator mesh 21. Inside the insulator drum 28 is provided a back electrode 30 opposite the corona charger 27, and further down are consecutively provided a developing device 29, a cleaning device 31, and a charge neutralizer by corona discharge 32. A recording paper 34 (which may be plain paper) to be fed in the direction of an arrow contacts the outer peripheral surface of the insulator drum 28, and the tonner image on the drum is transferred to the plain paper 34 by a corona charger for transferring purposes 33 and is fixed by a fixing device 35.

In the construction as described above, the insulator mesh 21 is charged by the corona charger 24 provided with mesh to an extent that the ion flow from the corona charger 27 can no longer pass through. Then, the charge in the vicinity of mesh apertures of the insulator mesh 21 corresponding to the dots to be recorded is neutralized by the corona pulse charger for recording 25. In other words, the positive charge uniformly charged on the insulator 22 of the insulator mesh 21 is neutralized by the negative ion flow applied on the insulator corresponding to the recording control signals to create a charge distribution. In this case, dots to be recorded correspond to selected apertures of the controlling electrode 25*b*, and pulses of such polarity as to allow passing of the negative ion flow through aperture of the control electrode from the pulse source 37 are applied to the selected apertures of the control electrode.

Figures 2A, 2B:
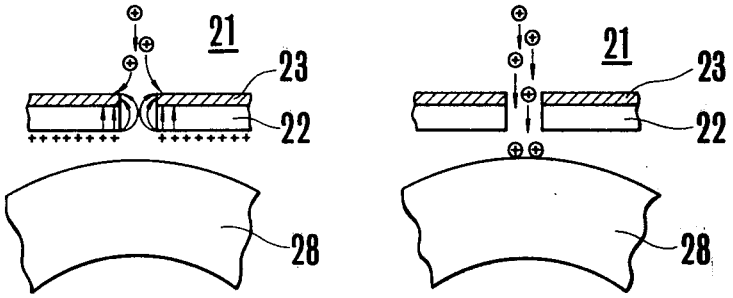
FIG. 2A to 2B are partly enlarged views showing the operational principle of the insulator mesh in accordance with the present invention.

Then, the ion flow from the corona charger 27 is applied from the side of conductive surface 23 of the insulator mesh 21, and the mesh portion which has not been neutralized by the ion flow pulse charger 25 for recording will not allow the ion flow to pass whereas the neutralized mesh portion will allow the flow to pass, thereby forming a pattern of electrostatic latent image corresponding to the dots to be recorded on the insulator drum 28. That is to say, in the uniformly charged state as shown in FIG. 2A, the positive ion flow from the corona charger 27 is subjected to repulsion by the positive charge on the insulator 22, being prevented from passing through the mesh apertures and absorbed into the conductive surface 23. On the other hand, in the neutralized state shown in FIG. 2B, since the mesh portion corresponding to the dots to be recorded has already been neutralized by negative ion flow from the ion flow pulse generator 25 for recording, the positive ion flow from the corona charger 27 can pass through the mesh apertures and form an electrostatic latent image on the insulator drum 28 according to the recording signals. Thereafter, the developing device 29 develops the image, the transferring corona charger 33 transfers the tonner image on the recording paper 34, and the fixing device 35 fixes the image, thereby completing the recording process.

Figure 3:
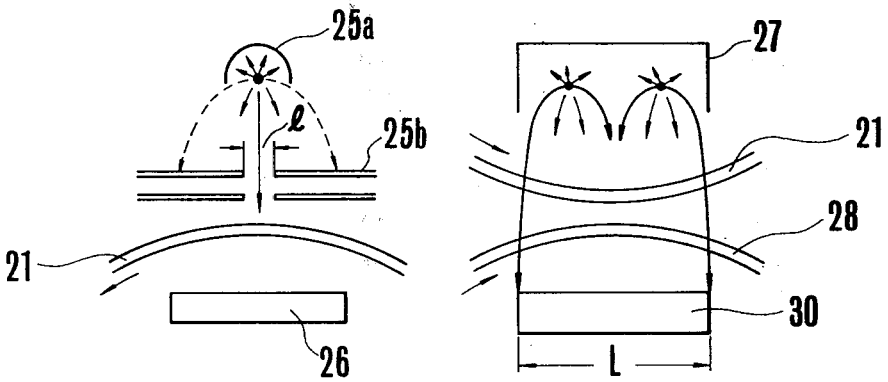
FIG. 3 is an explanatory view to show the principle of the electrostatic image amplification in accordance with the present invention.

In the above-mentioned process of electrostatic latent image forming, it should be particularly understood that the data given in the form of a charge distribution on the insulator mesh 21 is converted into a latent image having the charge amplified to that required for final recording. In initial recording, it is sufficient to apply to the insulator mesh 21 from the corona charger 25 a charge required for neutralizing the charge on the insulator mesh 21 correspondingly to the dots to be recorded (the former being the charge required for neutralizing the cut-off charge to be defined later as the charge required for preventing the ion flow from passing through the insulator mesh apertures, and corresponding to the cut-off charge). Accordingly, it is sufficient that, as shown in FIG. 3, of the ion flows flowing out radially from the corona source 25*a*, that passing through the aperture having the diameter of l of the controlling electrode 25*b* may be irradiated on the mesh 21 just for the short period of time required for the mesh 21 to pass. Because of a small charge required for the initial recording with the corona charger 25, the rotational speed of the insulator mesh 21 may be accelerated and the recording speed increased. On the other hand, when considering one mesh aperture corresponding to one dot for recording thus given on the mesh 21, it is found that this aperture passes through the operational range of the corona charger 27 extending to a width L of the back electrode 30 and therefore, it allows the passage of the ion flow therethrough for the duration corresponding to L. Setting the same values for the ion flow density of the corona chargers 25 and 27 and the same speed for rotating the insulator drum 28 and the insulator mesh 21, then the portion on the drum 28 corresponding to the dot to be recorded will be charged with a charge which is a multiple of the initial recording charge which is in approximate proportion to L/l.

In the present invention, since the thickness of the controlling electrode is in the order of 30 to 100 $\mu$m, a pulse of less than 50 V and less than several msec width is sufficient to create the electric field sufficient for ON-OFF control within the aperture. It is also possible to determine distance $d_1$ between the corona charger 25 and the insulator mesh 21, and distance $d_2$ between the insulator mesh 21 and the insulator drum 28 may be set at about 0.1 mm to 3 mm. With $d_1$ and $d_2$ being not less than 0.1 mm, the image disturbance by the tonner splash may be prevented.

Figure 4:
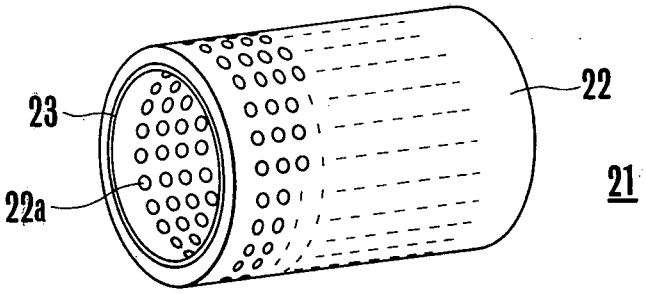
FIG. 4 is a perspective view showing the details of the insulator mesh of FIG. 1.

FIG. 4 shows the detail of the cylindrical insulator mesh 21 wherein a plurality of mesh apertures 22*a* are formed in the outer peripheral surface of the insulator 22 at predetermined pitches. Therefore, the conductive surface 23 will also become mesh-like. For example, a cylindrical insulator mesh is formed from conductive stainless steel mesh having a mesh size of 200 and 400 mesh/inch and coated with polymer material in such a way as not to fill the mesh apertures.

Figure 5:
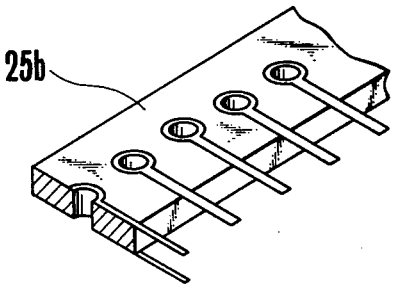
FIG. 5 is an enlarged perspective view, partly exploded, showing the construction of the recording control electrode.

The controlling electrode 25*b* of the corona charger 25 has a pair of electrodes holding an insulator plate therebetween as shown in FIG. 5. There are formed apertures penetrating through the insulator plate, one end of the electrode pair forming a ring along the aperture. When applying the voltage upon the electrode pair, there is created within the aperture associated with this electrode pair an electric field to ON-OFF control the ion flow.

Figure 6:
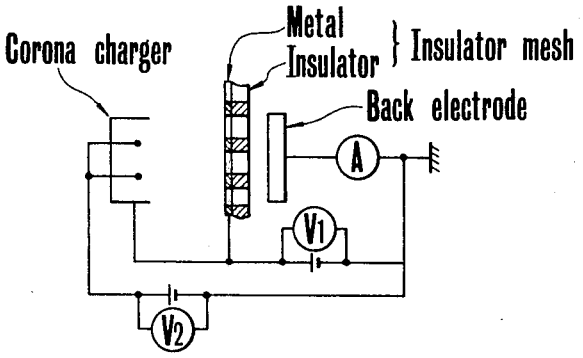
FIG. 6 is a connection diagram of the device used to obtain the control characteristic of the corona ion flow by the electrostatic latent image in the present invention.

The inventors of the present invention have conducted the following experiment in order to confirm the principle of the present invention and to obtain the basic data concerning the recording speed, especially basic controlling characteristic of the corona ion current due to the electrostatic latent image on the insulator mesh. FIG. 6 is a schematic connection diagram of the device used for the experiment.

A 1.0 mm thick acrylic plate was used as an insulator mesh on one side of which was formed a silver electrode by vacuum evaporation, having apertures of 0.5 mm, 1.0 mm and 1.5 mm diameters bored at a 10 mm pitch. The ion flow density (J) passing through the apertures was obtained by measuring with an ammeter A the current flowing to the back electrode.

Figure 7:
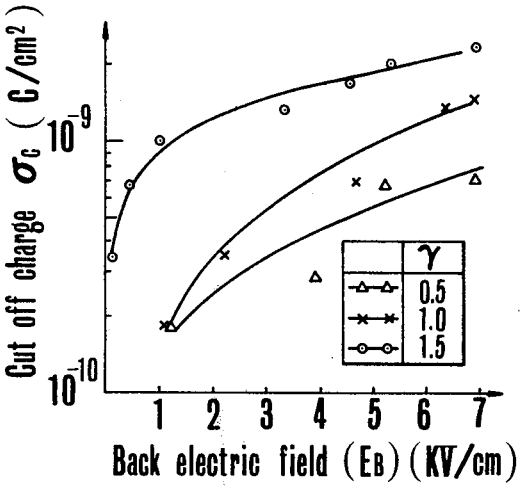
FIG. 7 is a graph showing the relation between the back electric field and the cut off charge.
Figure 8:
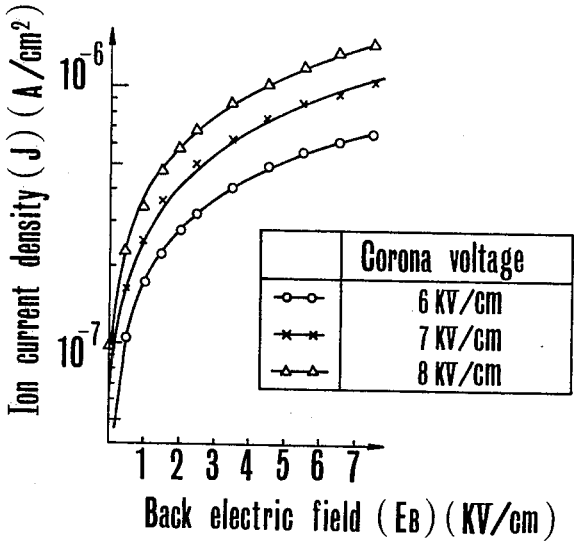
FIG. 8 is a graph showing the relation between the back electric field and the ion current density.

FIG. 7 shows the results of the experiment wherein the ordinate represents cut off charge $\sigma_c$ which is defined as the charge on the insulator mesh when the density of the corona ion flow passing the apertures becomes less than 10% with respect to a reference of the corona ion flow density passing the apertures in a state where the insulator mesh is not charged. The time required for recording the electrostatic latent image on the insulator mesh is determined by the time required for neutralizing the uniformly charged cut-off charge on the insulator mesh. FIG. 8 shows the corona ion density passing the electrode apertures in the insulator.

In the experiments, the recording time t is obtained from the following formula $$\Delta t = \sigma_c J$$

where $\sigma_c$ is cut off charge, J being determined by the corona charger used.

Figure 9:
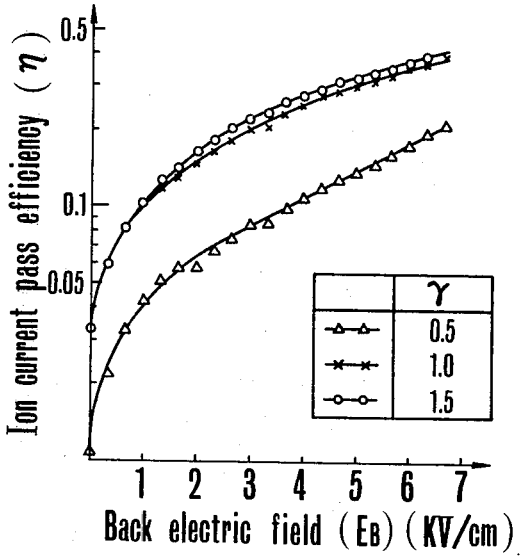
FIG. 9 is a graph showing the relation between the back electric field and the ion current passing efficiency.

In order to determine the time for irradiation of corona ions required for forming, by way of the electrostatic latent image on the insulator mesh, electrostatic latent images having the charge density amplified to the extent necessary for developing the latter latent images on the insulator drum, ratio n between the corona ion density at the conductive surface of the insulator mesh and the density of corona ion having passed through the apertures was measured. FIG. 9 shows the results of the experiment which reveals that the efficiency of the corona ion density (J') passing through the apertures is about 40%. FIG. 9 also teaches that the time T for forming electrostatic latent image which meets developing may be obtained from the formula $$T = \Delta\Sigma / J'$$

where $\Delta\Sigma$ is the amplified charge density on the insulator drum.

As an example, the recording speed is determined when corona voltage is 7 KV ($V_2$) and the back electric filed 7 KV/cm under the conditions that an insulator mesh has a relative dielectric constant $\Sigma$ of 4 and a mesh aperture diameter D of 0.1 mm and that ratio $\gamma$ between diameter D of the insulator mesh aperture and diameter D' of the recording control electrode aperture is 1 (one).

Namely, recording time $\Delta t$ is first obtained from the following formula $$\Delta t = \frac{\sigma_c}{J'} = \frac{1 \times 10^{-9}}{1.0 \times 10^{-6}} = 1 \times 10^{-3} \text{ [sec]}$$

Since r=1 and the aperture diameter D' of the recording control electrode is 0.1 mm, the speed $v_p$ of the insulator mesh is $$v_p = \frac{D'}{\Delta t} = \frac{0.1}{1 \times 10^{-3}} = 1 \times 10^2 \text{ mm/sec}$$

The time T for irradiating corona ion required for forming the electrostatic latent image which meets developing is obtained from the following formula as the charge required for the developing purpose is $6 \times 10^{-8}$ coulomb/cm$^2$.

$$\Delta T = \frac{\Delta\Sigma}{J'} = \frac{6 \times 10^{-8}}{0.4 \times 1 \times 10^{-6}} 1.5 \times 10^{-1} \text{ [sec]}$$

and the length L of corona charge for developing is obtained from the following formula:

$$L = T \times v_p = 1.5 \times 10^{-1} \times 1 \times 10^{1} = 1.5 \text{ (cm)}$$

Therefore, the recording speed of the present method is 10 cm/sec. Ratio between the charge density on the insulator mesh and the charge density of electrostatic latent image sufficient for developing is termed amplification degree of the latent image and becomes $$\frac{\Delta\Sigma}{\sigma_c} = \frac{6.0 \times 10^{-8}}{1 \times 10^{-9}} = 60$$

Figure 10:
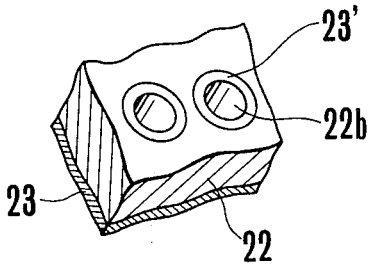
FIG. 10 is a partial perspective view showing a modified embodiment of the insulator mesh.

FIG. 10 shows a modified embodiment, in partly enlarged form, of the insulator mesh wherein the peripheral portions of the respective mesh apertures **22*b* of the insulator 22 which are opposite to the conductive surface 21 are deposited with conductors 23'. The mesh apertures 22 with the conductors 23' are electrically isolated from each other. When using such an insulator mesh, the charge distribution becomes uniform around the mesh apertures 22*b*, and mutual interference of ion flows at outlets of the mesh apertures may be minimized when the insulator mesh 21 is cooperating with the corona charger 27**, thus enabling more stable ion flow control.

Figure 11:
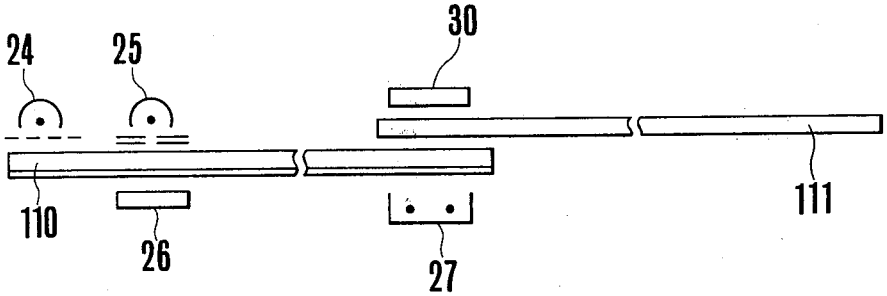
FIG. 11 is a schematic diagram of another embodiment of the present invention.

The above description was made of an embodiment wherein the insulator mesh 21 is formed like a cylinder and an electrostatic latent image is formed on the cylindrical insulator drum 28, but the invention is not to be limited to the above embodiment. As shown in FIG. 11, an insulator mesh 110 and an insulating recording substrate 111 may be formed like a belt or a plate and an electrostatic latent image may be formed thereon. In this case, the insulator mesh 110 is reciprocatingly supported and driven between the corona chargers 24 and 27, while the substrate 111 is supported and driven to move between the corona charger 27 and the back electrode 30. Alternatively, the mesh 110 and the substrate 111 may be stationary, and the corona charger and the back electrode may be movable.

Figure 12:
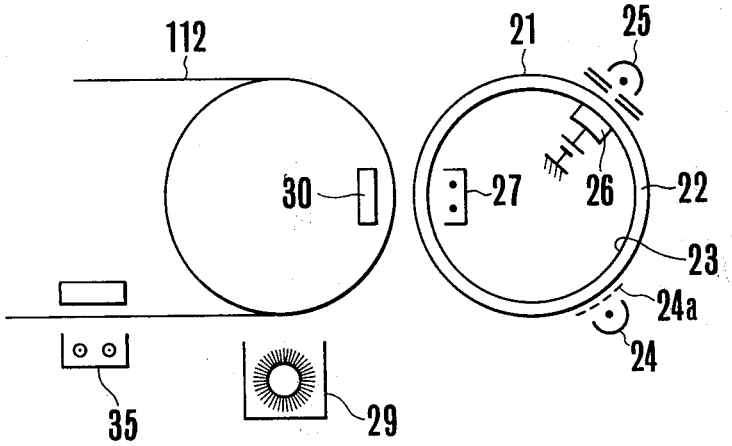
FIG. 12 is a schematic diagram showing still another embodiment of the present invention.

In the above mentioned embodiment, an example of recording on the recording paper 34 via the insulator drum 28 was described. This invention is not to be limited to this embodiment either. As shown in FIG. 12, it is also possible to directly record on an electrostatic recording paper 112 from the insulator mesh 21. In sum, both the insulator drum and the electrostatic recording paper suffice so long as they are the insulative recording substrate.

Although in the above embodiment there is formed the conductive surface 23 on the insulator 22, an insulator surface may conversely be formed on a conductive mesh. The mesh apertures do not necessarily have to be in register with dots to be recorded, but may be patterned as desired.

As explained hereinabove, according to this invention, it is possible to form desired patterns of electrostatic latent image on the insulating recording substrate by using the insulator mesh one surface of which is subjected to electroconductive treatment and amplifying the charge of the electrostatic image. Therefore, it is not necessary to use high voltage for record control and the insulator mesh and the insulating recording substrate may be sufficiently placed apart. Further, a high speed recording is possible because the electrostatic images are amplified as mentioned above. Also, it will be appreciated that, according to the invention data storage capability which enables about more than 100 copies per one recording can be ensured because the electrostatic latent images are maintained on the insulator mesh, and that it is possible to conduct the whole recording process electrically because a complex optical system is not required for adjusting the recording system because photosensitive substance is not used for insulator mesh.

What is claimed is:

1. An apparatus for electrostatic recording by doubly controlling ion flow comprising:

an insulator mesh supported movably and having one insulating surface and the other, opposite surface which is subjected to electroconductive treatment;

a first corona charger spaced apart from the one insulating surface of said insulator mesh, for uniformly charging said insulator mesh with electric charge of one polarity;

a second corona charger spaced apart a predetermined distance from said insulator mesh and having a control electrode with apertures, for providing on the one insulating surface a charge distribution corresponding to recording a control signal when the recording control signal is applied to the control electrode and ion current of the other polarity is applied to said insulator mesh through the apertures;

a third corona charger provided on the side of the other, electroconductive surface of said insulator mesh and spaced apart a predetermined distance from said insulator mesh, for forming an electrostatic latent image of the charge distribution whose charge is amplified as compared with that on said insulator mesh on an insulating recording substrate which is movable relative to said insulator mesh, by applying ion current of the one polarity to said substrate through the charge distribution on said insulator mesh; and means for finalizing a record by using the thus formed electrostatic latent image.

2. An electrostatic recording apparatus as recited in claim 1, wherein said insulator mesh and insulating recording substrate are cylindrical and revolve at substantially the same speed.

3. An electrostatic recording apparatus as recited in claim 1, wherein said control electrode with apertures comprises an insulator plate formed with apertures, and a plurality of paired electrode plates holding the insulator plate therebetween, and one end of said paired electrode plates is formed into an annular electrode enclosing the aperture.

4. An electrostatic recording apparatus as recited in claim 1, wherein a back electrode is provided which faces the third corona charger via the insulating recording substrate, the width of the back electrode along the direction in which the substrate moves contributing to the amplification of the charge.

5. An electrostatic recording apparatus as recited in claim 1, wherein the space respectively between said insulator mesh and the first corona charger, and the insulating recording substrate is not less than 0.1 mm and 3 mm at the most.

6. An electrostatic recording apparatus as recited in claim 1, wherein conductive portions are provided on the one insulating surface of the said insulator mesh enclosing the periphery of each mesh apertures.

7. An electrostatic recording apparatus as recited in claim 1, wherein said insulator mesh and insulating recording substrate are plane and move in a reciprocating fashion.

8. An electrostatic recording apparatus as recited in claim 1, wherein said record finalizing means has a recording paper fed in such a way that it contacts said insulating recording substrate surface, said recording paper being plain paper and onto the surface of which is transferred the tonner image resulting from development of the electrostatic latent image with tonner.

9. An electrostatic recording apparatus as recited in claim 1, wherein said insulating recording substrate is an electrostatic recording paper included in said record finalizing means.

10. A method for electrostatic recording by doubly controlling ion flow comprising the steps of:

uniformly charging one surface of an insulator mesh, the other, opposite surface of which is subjected to electroconductive treatment;

providing a charge distribution corresponding to the dots to be recorded on the one surface of said insulator mesh, by feeding to said insulator mesh corona current controlled by a recording signal through a control electrode with apertures;

applying ion flow from the side of the electroconductive surface of said insulator mesh and controlling the ion flow by said charge distribution on said insulator mesh to form, on an insulating recording substrate, an electrostatic latent image of the charge distribution whose charge is amplified as compared with that on said insulator mesh; and finalizing a record using the thus formed electrostatic latent image.

11. An electrostatic recording method as recited in claim 10, wherein said insulator mesh is formed by coating polymer materials on a conductive mesh.

12. An electrostatic recording method as recited in claim 10, wherein said recording signal is applied to a conrol electrode of a thickness in the order of 30 to 100$\mu$ for said corona current controlling.

* * * * *